United States Patent [19]

McRae

[11] 4,230,544

[45] Oct. 28, 1980

[54] METHOD AND APPARATUS FOR CONTROLLING ANODE PH IN MEMBRANE CHLOR-ALKALI CELLS

[75] Inventor: Wayne A. McRae, Zurich, Switzerland

[73] Assignee: Ionics Inc., Watertown, Mass.

[21] Appl. No.: 71,637

[22] Filed: Aug. 31, 1979

[51] Int. Cl.³ ..... C25B 1/34; C25B 9/00; C25B 15/08; C25B 13/08

[52] U.S. Cl. ..... 204/98; 204/128; 204/258; 204/266; 204/290 R; 204/290 F; 204/296; 204/262

[58] Field of Search ..... 204/98, 128, 258, 266, 204/290 R, 290 F, 296, 262

[56] References Cited

U.S. PATENT DOCUMENTS

| | | | |
|---|---|---|---|
| 4,025,405 | 5/1977 | Dotson et al. | 204/98 |
| 4,100,050 | 7/1978 | Cook, Jr. et al. | 204/98 |

*Primary Examiner*—R. L. Andrews

*Attorney, Agent, or Firm*—Norman E. Saliba

[57] ABSTRACT

An improved process and apparatus for pH control in the anode compartments of membrane chlor-alkali cells is disclosed wherein an anode is used having an oxygen evolution efficiency substantially equivalent chemically to the hydroxide ion transfer efficiency of the membrane.

16 Claims, 4 Drawing Figures

METHOD AND APPARATUS FOR CONTROLLING ANODE PH IN MEMBRANE CHLOR-ALKALI CELLS

BACKGROUND OF THE INVENTION

1. Field of the Invention

The invention resides in the field of electrolytic devices and more particularly relates to chlor-alkali or alkali metal chloride cells containing cation selective membranes.

2. Description of the Prior Art

The electrolysis of chlorides of monovalent cations (including lithium, sodium, potassium, rubidium, cesium, thallium and tetra methyl ammonium) with cation selective membranes is well known for the production of chlorine and the hydroxides of such cations, particularly with respect to the conversion of sodium chloride to chlorine and castic. In the sodium chloride process the electrolysis cell is divided into anode and cathode compartments by a permselective cation membrane. Brine is fed to the anode compartment and water to the cathode compartment. A voltage impressed across the cell electrodes causes the migration of sodium ions through the membrane into the cathode compartment where they combine with hydroxide ions formed from the splitting of water at the cathode to form sodium hydroxide (caustic soda). Hydrogen gas is formed at the cathode and chlorine gas at the anode. The caustic, hydrogen and chlorine may subsequently be converted to other products such as sodium hypochlorite or hydrochloric acid.

The efficiency of these cells for production of caustic and chlorine depends upon how they are operated, that is, the balancing of the chemical parameters of the cell and the internal use of the products and further how the cells are constructed, i.e. what materials are used to form the components and what system flow paths are employed.

One particular concern in attaining efficiency is the control of the pH of the brine in the anode compartment. It is desirable to maintain the level as acidic as is necessary and sufficient to inhibit the formation of sodium chlorate in the brine particularly when a recirculating brine is employed. Sodium chlorate is formed when hydroxide ions migrate from the cathode compartment through the membrane into the anode compartment. Adding hydrochloric acid to the anode compartment neutralizes the hydroxide ions and inhibits chlorate build up in a recirculating system. Such a procedure has been described in U.S. Pat. Nos. 3,948,737, Cook, Jr., et al. and elsewhere.

The present invention comprises an improvement over the above discussed prior art techniques. The overall or system chlorine evolution efficiency of such techniques is at any rate essentially limited to the cation transfer efficiency of the cation selective membrane as may be shown by the following system chemical equations:

Membrane:

$$\bar{t}_+Na^+(\text{anode}) \rightarrow \bar{t}_+Na^+(\text{cathode}) \quad (1)$$

$$(1-\bar{t}_+)OH^-(\text{cathode}) \rightarrow (1-\bar{t}_+)OH^-(\text{anode}) \quad (2)$$

Anode:

$$(1-\bar{t}_+)HCl + (1-\bar{t}_+)OH\ (\text{anode}) \rightarrow (1-\bar{t}_+)H_2O + (1-\bar{t}_+)Cl^- \quad (3)$$

$$Cl^- \rightarrow 0.5\ Cl_2 + (F)e^- \quad (4)$$

Cathode:

$$H_2O + (F)e^- \rightarrow OH^- + 0.5H_2 \quad (5)$$

Hydrogen-Chlorine Burner:

$$0.5(1-\bar{t}_+)Cl_2 + 0.5(1-\bar{t}_+)H_2 \rightarrow (1-\bar{t}_+)HCl \quad (6)$$

$$\bar{t}_+NaCl + \bar{t}_+H_2O \rightarrow 0.5\bar{t}_+Cl_2 + \bar{t}_+NaOH + 0.5\bar{t}_+H_2 \quad (7)$$

(Equation (7) represents the sum of the equations.) In the above equations $\bar{t}_+$ represents the fraction of the current carried by cations passing from the anode compartment to the cathode compartment, the remainder of the current, $(1-\bar{t}_+)$, being carried by hydroxide ions passing from the cathode compartment through the membrane to the anode compartment. (F) represents Faraday's constant, the quantity of electricity theoretically required to produce one gram equivalent of chlorine and $e^-$ represents an electron. It will be seen from equation (7) that although the addition of acid (equation (3)) will neutralize the hydroxide ion penetrating the membrane and inhibit chlorate formation thereby, the system efficiency for chlorine evolution is not affected. This may be seen by comparing with the following equations:

Anode:

$$(1-\bar{t}_+)OH^-\ (\text{anode}) + 0.5(1-\bar{t}_+)Cl_2 \rightarrow 0.5(1-\bar{t}_+)OCl^- + 0.5(1-\bar{t}_+)Cl^- + 0.5(1-\bar{t}_+)H_2O \quad (8)$$

The sum of equations (1), (2), (8), (4) and (5) is:

$$\bar{t}_+Na^+ + 0.5(1+\bar{t}_+)Cl^- + 0.5(1+\bar{t}_+)H_2O \rightarrow \bar{t}_+NaOH + 0.5\bar{t}_+Cl_2 + 0.5(1-\bar{t}_+)OCl^- + 0.5\ H_2 \quad (9)$$

The hypochlorite ion ($OCl^-$) may decompose by one of two routes:

$$2\ OCl^- \rightarrow O_2 + 2Cl^-; \quad (10)$$

and $$2\ OCl^- \rightarrow ClO_3^- + 2Cl^- \quad (11)$$

Comparing equation (7) and (9) it will be seen that the system production of chlorine is the same but that the latter system produces some hypochlorite and thereby some chlorate. The former system has the disadvantage of requiring an expensive, dangerous chlorine-hydrogen burner.

In accordance with the present invention the acidity in the anode compartment is controlled, chlorate is substantially eliminated, a hydrogen-chlorine burner is eliminated and the system chlorine efficiency is maintained. This is accomplished by utilizing in the membrane cell an anode having an oxygen evolution efficiency substantially equivalent chemically to the hydroxide transfer efficiency of the membrane. Such anode may, for example, have at least one region having a higher oxygen evolution efficiency than the remaining regions.

SUMMARY OF THE INVENTION

The invention may be summarized as an improved method and apparatus for controlling and maintining the pH of a recirculating brine for a membrane type chlor-alkali electrolysis cell, particularly a cell suited for converting sodium chloride or brine to sodium hydroxide (or caustic) and chlorine. An anode is employed having an oxygen evolution efficiency substantially chemically equivalent to the current efficiency of the membrane for transfer of hydroxide from the cathode compartment to the anode compartment. The anode may consist of at least one region having a higher oxygen evolution efficiency than the remaining regions. Optionally the apparatus may be "fine-tuned", for example, by controlling the concentrations of sulfate and chlorate in the recirculating brine or by varying the current densities in the region(s) having higher oxygen evolution efficiency compared with those having lower oxygen evolution efficiency.

Controlling the pH of the anolyte in the above manner yields several advantages. It is generally agreed that in a recirculating cell of this type it is important not to contaminate the saturated brine anolyte with excessive sodium chlorate which will form an accumulate if the hydroxide ion leakage from the cathode compartment through the cell membrane into the anode compartment is not substantially neutralized. Adding an acid such as HCl from an external source in the prior art manner will increase the cost of and reduce the economic feasibility of the process. Controlling the pH can assist in the control of the formation of insoluble metallic hydroxides in the membrane and prolong the economically useful life of the membrane. A lower pH than the controlled value may contribute to reduced alkali current efficiency and to the degradation of the cell itself, depending upon the construction materials. Obviously the reverse of the above is also true; if the pH is higher than the controlled value excessive hypochlorite and/or chlorate will form in the recirculating brine.

The construction and operation of the cell and system comprising the invention will be more fully explained in the description of preferred embodiments taken in conjunction with the drawings which follow:

DESCRIPTION OF PREFERRED EMBODIMENTS

Figure 1:
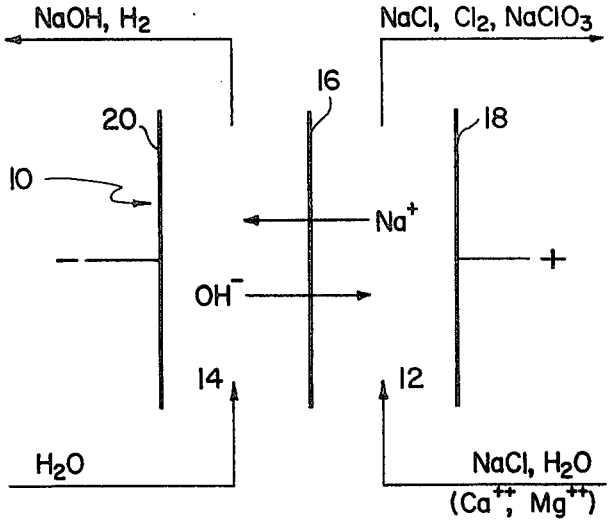
FIG. 1 is a schematic representation of a conventional membrane chlor-alkali cell.

Referring to FIG. 1, there is shown a schematic representation of an electrolysis cell 10 suitable for practice according to the prior art. The cell comprises an anode compartment 12 and a cathode compartment 14 separated by a cation permselective membrane 16. Anode 18 is comprised of an electrolytic valve metal such as titanium, tantalum, niobium or zirconium or their alloys having an electrically conducting coating thereon which has a comparatively low overvoltage for chlorine evolution and a high overvoltage for oxygen evolution. Under preferred cell operating conditions, that is, a temperature in excess of 70° C., substantially saturated brine in the anode compartment and a low pH in the anode compartment, such anodes typically have a chlorine evolution efficiency of about 98 percent. Suitable coatings include:

(a) finely divided ruthenium oxide;
(b) a mixture of finely divided ruthenium oxide and titanium oxide modified with various other insoluble oxides;
(c) finely divided iridium oxide bonded with platinum metal;
(d) substoichiometric monovalent metal platinates;
(e) a mixture of finely divided palladium oxide and titanium dioxide;
(f) a mixture of finely divided cobaltous cobaltate spinel (or zinc cobaltate spinel) and titanium dioxide.

Cathode 20 may be a conventional carbon steel or nickel cathode optionally having a high surface area coating of nickel or cobalt to reduce hydrogen overvoltage. Alternatively cathode 20 may be an oxygen or air depolarized electrode such as a Raney nickel electrode or porous carbon having a silver oxide or colloidal platinum catalyst. Other types of oxygen depolarized catalytic electrodes well known in the art may be used. The membrane 16 may be composed of a conventional cation exchange material such as is well known in the art or preferably of a perfluorinated carboxylic acid, sulfonic acid or sulfonamide type such as is manufactured by E. I. du Pont de Nemours and Co. Inc. under the trademark NAFION®; by Asahi Glass Co., Ltd. (Tokyo, Japan) under the trademark FLEMION; by Asahi Chemical Industry Co., Ltd (Tokyo, Japan); or by Tokuyama Soda Co., Ltd (Tokyo, Japan). Such a membrane of the carboxylic type typically has the chemical formula:

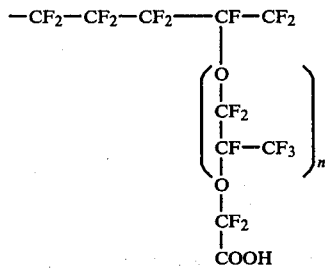

Although for sake of clarity the membrane and electrodes in FIG. 1 are shown as spaced from each other, it will be understood that either or both electrodes may be in direct contact with the membrane in which case the electrode must have a multiplicity of apertures to allow escape of gaseous electrolysis products. When such a foraminous electrode is in contact with the membrane its active coating may be embedded in the membrane surface rather than adhering to the electrode substrate.

A direct current voltage is impressed on the electrodes 18 and 20 from a source not shown. The anolyte (a concentrated substantially saturated brine solution) may be constantly recirculated and replenished by means not shown in apparatus which would be obvious to those skilled in the art. In the operation of the cell, water (or dilute sodium hydroxide) is normally fed to the cathode compartment from a source not shown and sodium hydroxide (formed from sodium ions from the anode compartment and hydroxide ions from the cathode) is withdrawn by means also not shown. The catholyte may be operated on a once through basis or an recirculation. If a highly concentrated caustic solution is desired, the cell may be operated without external water feed to the cathode compartment. In such case the required water will be supplied to the cathode compartment solely by water transfer through the membrane. Hydrogen is evolved at the cathode in the case of the utilization of conventional cathodes or oxygen is reduced in the case of the air or oxygen depolarized cathodes described above. Chlorine is evolved at the anode with as pointed out above, trace amounts of oxygen. Although membrane 16 is a cation permselective membrane, some hydroxide ions will still migrate into the anode compartment resulting in the formation of sodium hypochlorite, sodium chlorate and oxygen unless inhibited by a similar supply of hydrogen ions. The inhibition may be accomplished by introducing acid from an external source into the anode compartment with the brine according to the prior art.

In the operation of such membrane chlor-alkali cells, the feed to the anode compartment is normally a substantially saturated brine containing very low concentrations of non-monovalent cations such as calcium and magnesium. The effluent from the cathode compartments is alkali, e.g., NaOH generally in the concentration range from about 5 percent to about 40 percent. Calcium and magnesium hydroxides (as well as hydroxides of other non-monovalent cations) are very insoluble in alkalies of such concentrations. For example, the solubility product of $Ca(OH)_2$ is about $4\times10^{-6}$ at 85° C. from which one may calculate that the solubility of $Ca^{++}$ in 8 percent NaOH is about 0.04 ppm. As pointed out above the cation membranes used in such cells are not perfectly permselective; typically the current efficiency for $Na^+$ is about 80 to 90 percent (though higher efficiencies can be obtained with some membranes when new) and the current efficiency for $OH^-$ about 10 to 20 percent in alkali solutions having concentrations of commercial interest. As a result $Ca(OH)_2$ and $Mg(OH)_2$ tend to precipitate in the membrane, $OH^-$ passing through the membrane from the cathode compartment and $Ca^{++}$ and $Mg^{++}$ passing through the membrane from the anode compartment. These precipitates result in an increase in electrical resistance of the membrane and, if allowed to grow, eventually to destruction of the integrity of the membrane and to decrease in the current efficiency for $Na^+$ transfer. It is known to reduce the concentration of $Ca^{++}$ and $Mg^{++}$ (and other non-monovalent cations) by pretreatment of the brine e.g.:

(a) by precipitation of $CaCO_3$ and $Mg(OH)_2$ by adding $Na_2CO_3$ and NaOH followed by careful filtration;

(b) by ion exchange using chelating ion exchange resins, for example, those containing imino diacetic acid groups such as Dowex A-1 (Dow Chemical Co.), Amberlite 1RC-718. (Rohm and Haas Co.) or DIAION CR-10 (Mitsubishi Chemical Co., Ltd., Tokyo, Japan); or using liquid chelating agents such as di-ethyl hexyl phosphoric acid dissolved in kerosene;

(c) precipitation of calcium phosphate and magnesium hydroxide by adding sodium phosphate (or phosphoric acid) and sodium hydroxide followed by careful filtration.

Particularly in the case of the first treatment, the $Ca^{++}$ and $Mg^{++}$ concentrtions may not be reduced sufficiently to prevent precipitation of $Ca(OH)_2$ and $Mg(OH)_2$ in the membrane, although the rate of growth will be substantially reduced, compared to untreated brine. It is known in such case to add phosphoric acid to the brine before feeding it to the cell and to add aqueous HCl to maintain a low pH (e.g. 2 or even less) in the anolyte. These additives significantly slowdown, although they do not completely prevent, the formation of $Ca(OH)_2$ and $Mg(OH)_2$.

The HCl added to the brine before feeding the latter to the anode compartment has another effect, in that it increases the apparent current efficiency for chlorine evolution at the anode. However as will be explained, this is an illusion, Hydroxide ions penetrating the cation exchange membrane to the anode compartment react with free chlorine there to form hypochlorite:

$$Cl_2+2OH^-\rightarrow OCl^-+Cl^-+H_2O$$

At the temperature in the cell, the hypochlorite decomposes by two mechanisms:

$$2\,OCl^-\rightarrow O_2+2Cl^-;$$

and $$3\,OCl^-\rightarrow ClO_3^-+2Cl^-$$

In either case the entry of an equivalent of $OH^-$ causes the loss of an equivalent of $Cl_2$ and a decrease therefore in chlorine efficiency. Part of the $O_2$ in the gaseous effluent from the anode compartment comes from such mechanisms; part appears to come from chlorate and sulfate in the brine occupying active sites on the anode in place of chloride, resulting in the oxidation of water to oxygen instead of chloride to chlorine.

Adding HCl to the brine before feeding it to the cell can neutralize most or all of the $OH^-$ entering the anode compartment:

$$OH^-+HCl\rightarrow H_2O+Cl^-$$

This will inhibit the formation of $OCl^-$ and $ClO_3^-$ and result in an instantaneous but illusory increase in chlorine efficiency. The increase is illusory since the HCl must be obtained from some external source, typically the burning of $H_2$ and $Cl_2$ produced by electrolysis of NaCl:

$$H_2+Cl_2\rightarrow 2HCl$$

Of course the increase in current efficiency is not illusory if low cost, by-product HCl is available which is not commonly the case, however. It will still be illusory if HCl is purchased at commercial prices since it can be shown that commercial prices are equal to or more expensive than burning $H_2$ and $Cl_2$.

Figure 2:
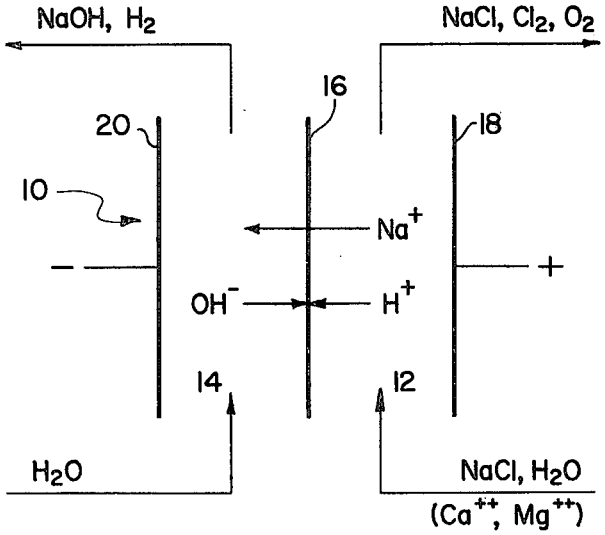
FIGS. 2 and 3 are schematic representions of preferred embodiments of the invention, showing various preferred methods of operation.

Referring to FIG. 2, there is shown a schematic representation of a preferred embodiment of an electrolysis cell 10 suitable for the practice of the invention. Like components in FIGS. 1 and 2 are similarly numbered. Anode 18 is comprised of an electrolyte valve metal such as titanium, tantalum, niobium, zirconium or their alloys having an electrically conducting coating thereon which on the average has an oxygen evolution current efficiency substantially equal to the current efficiency of the membrane for transfer of hydroxide from the cathode compartment to the anode compartment. Although such coatings may be made using suitable additives to the coatings listed in connection with FIG. 1 a preferred and simple method is to fabricate an anode having a quite high oxygen evolution efficiency in at least one region and a quite high chlorine evolution efficiency in the remaining regions, the relative areas being adjusted to substantially match the membrane hydroxide efficiency. Oxygen evolution from the anode is accompanied by $H^+$ ion generation:

$$2H_2O \rightarrow O_2 + 4H^+ + 4e^-$$

For example, an anode, having one or more of the coatings listed in connection with FIG. 1 may have an oxygen selective coating applied over the lower part. If the membrane hydroxide efficiency is for example about 10 percent then about 10 percent of the area of the anode should be coated with the oxygen selective coating. In a preferred procedure a solution is prepared containing a few percent of sodium chloride and about 150 ppm of $Mn^{++}$ ion. The pH is adjusted to less than 1 with hydrochloric acid, the area of the anode to be coated is immersed in this solution and electrolyzed at a current density of about 15 amperes per square decimeter. The current is continued until substantially all of the gaseous electrolysis product is oxygen. Usually 15 to 20 minutes is sufficient. The exposed region on the anode will have about 1 milligram of manganese per square decimeter, apparently as amorphous manganese dioxide. The coating will evolve oxygen from substantially saturated brine at roughly 95 percent efficiency. Although this is a preferred method of making an anode useful in this invention it will be understood that any method which substantially balances the oxygen evolution efficiency to the hydroxide ion transport efficiency will be satisfactory.

It will be understood that the hydroxide transport efficiency of a cation selective membrane in a chlor-alkali cell increases slowly with time. Therefore it is not possible (or is it necessary) to have a precise match between the membrane hydroxide on efficiency and the anode oxygen efficiency. If the change in membrane efficiency is substantial then it may be desirable to recoat the anode increasing its oxygen evolving area or to replace it with an anode having a larger oxygen evolving area. In a commercial plant, as membranes age they may be scheduled through the plant, matched with anodes having progessively larger oxygen evolving areas.

During operation the anodes may be "fine tuned" to approximately match the changing hydroxide ion efficiency of the membrane. Such electrodes tend to be self-regulating; if the pH increases, then $O_2$ evolution and $H^+$ production tend to increase; if the pH decreases, then $O_2$ evolution and $H^+$ production tend to decrease. For example, the anode may be matched to the current efficiency of a new membrane. As the membrane ages the hydrogen ion production by the anode will become insufficient to neutralize all the hydroxide entering the anode compartment. The operation may be fined tuned be deliberately allowing the concentration of sulfate and chlorate to build up until the $O_2$ evolution and $H^+$ generation are as desired. The deficiency in $H^+$ generation with old membranes may of course be made up by some external acid addition to the brine stream but in accordance with the invention that amount will always be less than would be the case for conventional membrane chlor-alkali cells of the prior art.

Figure 3:
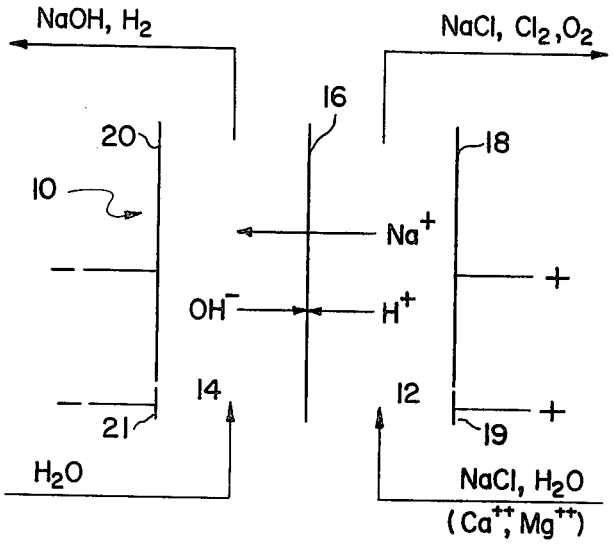

Referring to FIG. 3, there is shown a schmeatic representation of a second preferred embodiment of this invention which permits a high degree of fine tuning to match the aging of the membrane. Like components in FIGS. 1, 2 and 3 are similarly numbered. Anode 18 of FIG. 2 is replaced by segmented anode 18–19 and cathode 20 is replaced with segmented cathode 20–21. Segment 18 of the anode has a conventional relatively high chlorine evolution efficiency and segment 19 a relatively low chlorine efficiency. Direct current electricity is applied more or less independently between anode segment 18 and cathode segment 20 on the one hand and anode segment 19 and cathode segment 21 on the other; the relative current densities being adjusted substantially to compensate for the aging of the membrane. Such adjustment may be used in conjunction with control of sulfate and chlorate in the recirculating brine to fine-tune $H^+$ generation in the anode compartment. The arrangement in FIG. 3 is particularly adaptable to a circuit of monopolar membrane chlor-alkali cells. In other cases it may not be necessary for both the anode and the cathode to be segmented.

In general the over-potentials of the oxygen rich and the chlorine rich areas will not be the same. The relative areas will therefore not be proportional to the desired $O_2$ and $Cl_2$ evolutions but will be given by solving the following simultaneous equations:

$$Cl_2 \text{ evolved} = E_{C12} i_{C12} A + (1 - E_{02}) i_{02} A_{02} \quad \text{(A)}$$

$$O_2 \text{ evolved} = (1 - E_{C12}) i_{C12} A_{C12} + E_{02} i_{02} A_{02} \quad \text{(B)}$$

$$V_P = i_{C12} R_P + V_{C12} + V_C + V_M \quad \text{(C)}$$

$$V_P = i_{02} R_P + V_{02} + V_C + V_M \quad \text{(D)}$$

where the subscript C12 refers to the anode region having higher $Cl_2$ efficiency; the subscript 02 refers to the anode region having relatively higher $O_2$ efficiency; E represents current efficiency; i represents current density; A represents apparent area (that is the area of membrane opposite the given anode area); $V_P$ is the total cell potential; $V_C$ is the half cell potential of the cathode; $V_M$ is the membrane potential (that is the thermodynamic potential between the liquid adjacent to the cathode and that adjacent to the anode); $R_P$ is the ohmic resistance of the cell and $V_{C12}$ and $V_{02}$ are the half cell potentials of the $Cl_2$ rich and $O_2$ rich regions respectively. $V_P$, $V_C$, $V_M$, $R_P$, $E_{C12}$, $E_{02}$, $Cl_2$ evolved, $V_{C12}$ and $V_{02}$ are known or specified quantities ($V_{C12}$ and $V_{02}$ are generally known as a function of $i_{C12}$ and $i_{02}$ respectively). There are thus four unknowns ($i_{C12}$, $i_{02}$, $A_{02}$ and $A_{C12}$) and four equations. The values of the four unknowns may therefore be obtained by the conventional solution of the system of equations. While such calculation is a great help in designing an electrode useful according to this invention, it is not essential and entirely satisfactory anodes can be obtained by a few trials varying, for example, the relative areas coated as described. It should be noted that in the case of expanded metal or woven anodes the apparent half-cell potentials $V_{02}$ and $V_{C12}$ can be varied independently by varying the specific surface area of each region; that is the actual anode area of the region divided by the membrane area directly opposite.

The operation and concept of the invention will be further understood from the following examples:

EXAMPLE 1

This example illustrates operation of a conventional membrane chlor-alkali cell in accordance with the prior art. An electrolytic cell is constructed in accordance with FIG. 1. The membrane is a perfluoro sulforic acid type furnished by E. I. du Pont de Nemours and Co., Inc. under the trade name NAFION® and consists of a thin skin having an equivalent weight of about 1350 laminated to a substrate having an equivalent weight of about 1100. The membrane is reinforced with a woven polyperfluorocarbon fabric also manufactured by the du Pont Co. under the tradename TEFLON®. The effective area of the membrane is about 1 square decimeter. A perfluorocarboxylic acid membrane such as that manufactured Asahi Glass Co., Ltd (Tokyo, Japan) under the tradename FLEMION may also be used. The cathode is expanded carbon steel; the anode is expanded titanium which has been coated on the face adjacent to the membrane with several layers of finely divided ruthenium oxide powder painted on in a slurry and baked at an elevated temperature to promote adhesion to the substrate as is well known in the art. The electrodes have apparent areas of about 1 square decimeter. The electrodes are spaced from the membrane to permit gas evolution and disengagement. Sodium chloride brine, substantially saturated, and having concentrations of non-monovalent cations less than about 1 ppm each is fed to the anode compartment at a rate of about 300 cubic centimeters per hour. The effluent from the anode compartment is separated into a gas stream and a liquid stream. From about 1 to about 10 percent of the effluent liquid stream is sent to waste; the remainder with additional water is resaturated with salt and used as feed to the anode compartment.

About 5 percent sodium hydroxide is fed to the cathode compartment. The feed rate is adjusted to produce an effluent from the cathode compartment having a concentration of about 10 percent. The effluent from the cathode compartment is also separated into a gas stream and a liquid stream. Part of the liquid stream is diluted with water and used as feed to the cathode compartment.

After the flows to the electrode compartments have been established, a direct current of about 25 amperes is imposed on the cell. After several hours, the voltage of the cell stabilizes at about 4.5 volts. The temperatures of the effluents from the cell are adjusted to about 80° C. by controlling the temperatures of the feeds to the electrodes.

The gas stream separated from the effluent from the anode compartment is analyzed by absorption in cold sodium hydroxide and titration of the latter for available chlorine. The current efficiency for chlorine evolution is found to about 85 percent. The pH of the liquid stream separated from the effluent from the anode compartment is found to be substantially greater than 4. It is analyzed for chlorate and it is found that chlorate production is about 1.5 grams per hour.

EXAMPLE 2

The anode from the cell of Example 1 is removed from the cell and approximately the lower 15 percent is immersed in a solution containing about 3 percent sodium chloride, 0.34 grams per liter of $MnCl_2$ (about 0.15 grams of $Mn^{++}$ per liter) adjusted to a pH of less than about 1 with aqueous hydrochloric acid. A current of about 2¼ amperes is passed through the anode (as an anode) against a piece of platinum foil as a working cathode. The solution is maintained at about 0.15 grams of $Mn^{++}$ per liter by adding additional $MnCl_2$ solution as required. Initially most of the gas evolved from the anode is chlorine but after about 20 minutes most of the gas is oxygen. The anode is removed rinsed, with water and reinstalled in the cell of Example 1. The cell is operated as described in Example 1. It is found that the current efficiency for chlorine evolution is still about 85 percent but the pH of the liquid stream separated from the effluent from the anode compartment is found to be substantially less than 4. It is analyzed for chlorate and it is found that chlorate production is about 0.5 grams per hour.

Similar results are obtained when the anode is prepared from a substoichiometric lithium platinate instead of ruthenium oxide; when the current density is varied throughout the range of from about 10 to about 35 amperes per square decimeter; and when the temperature of the catholyte is varied within the range of from about 70° to about 95° C.

EXAMPLE 3

The ruthenium oxide/manganese oxide anode of Example 2 is removed from the cell, the manganese oxide portion carefully cut away from the ruthenium oxide portion and the manganese oxide portion connected to an independently controlled source of direct current as shown in FIG. 3 except the cathode is not segmented. The cell is operated in Example 1 except the current in the ruthenium oxide segment is adjusted to about 21.3 amperes and the current through the manganese oxide segment is independently varied. It is found that the pH of the liquid effluent from the anode compartment may be varied throughout the range of from about 2 to about 4 by adjusting the current in the manganese oxide sector. The chlorate production similarly varies from about 0.1 to about 0.5 grams per hour.

It is found that when the brine fed to the anode compartment has concentrations of calcium and magnesium ion typical of those obtained from pretreatment of conventional brine with an excess of sodium carbonate and sodium hydroxide (followed by fine filtration) and the liquid effluent from the anode compartment has a pH of about 4 then the voltage of the cell slowly increases. Under the same conditions when the pH of the liquid effluent has a pH of about 2, the increase in voltage is almost undetectable over the course of a few weeks operation compared to the random variations in the voltage measured. It is also found that after the cell has operated for sometime at an anode effluent pH of about 4 and the cell voltage has increased appreciably, the voltage may be brought back to substantially its initial value by operating for a comparatively short period with an anode effluent pH of about 2 or less. The anode effluent is then again returned to a pH of about 4 by decreasing the current to the oxygen rich anode segment. It is found that by such cyclic operation, that is operating repeatedly with the anode liquid effluent first at the high end of the pH range of from about 2 to about 4 and then at the low end of the range that essentially stable opertion can be obtained and the energy consumption is less than by operating continuously at an anode effluent of pH 2.

Similar results are obtained when the chloride rich anode segment is replaced by a segment consisting of expanded titanium sheet having a thermally deposited coating comprising iridium oxide bonded with platinum metal.

EXAMPLE 4

A cell in accordance with Example 2 is operated as in Example 2 except that the brine feed contains calcium and magnesium ion concentrations typical of commercial brine which has been conventionally treated with an excess of sodium carbonate and sodium hydroxide followed by fine filtration. It is found that when from about 100 to about 500 ppm of phosphate ion is added in the form of phosphoric acid, sodium phosphate or sodium acid phosphate or when an equivalent amount of sodium phosphite or sodium hypophosphite is added then the voltage of the cell increases substantially less rapidly than when such materials are not added.

EXAMPLE 5

Five cells are constructed as described in Example 2 and FIG. 2. Brine is fed in parallel to the anode compartments of each cell at a rate of about 300 cubic centimeters per hour. The effluent from the cathode compartment of the first cell is separated into a liquid fraction and a gaseous fraction. The liquid fraction is used as the feed to cathode compartment of the second cell. Similarly the cathode liquid effluent from the second cell becomes the feed to the cathode compartment of the third cell and so forth so that the cathode compartments of the five cells are in liquid series. About 5 percent sodium hydroxide is fed to the cathode compartment of the first cell at such a rate that about 20 percent caustic is found in the liquid effluent from the cathode compartment of the fifth cell. Part of the liquid effluent from the fifth cathode compartment is diluted with water and used as feed to the first cathode compartment. A direct current of about 25 amperes is imposed on each cell. The curent efficiency for chlorine evolution is found to be about the same as found in Example 2, that is, even though the caustic concentration has been increased by a factor of about two, the series operation has permitted the current efficiency to be about the same. The hot effluent from the fifth cathode compartment is cooled by a vacuum assisted flash evaporation utilizing the sensible heat of the liquid. Part is taken as product, part diluted with water to become feed to the first cathode compartment and the remainder is recirculated as coolant to cool the cathode feeds to the cells.

EXAMPLE 6

Figure 4:
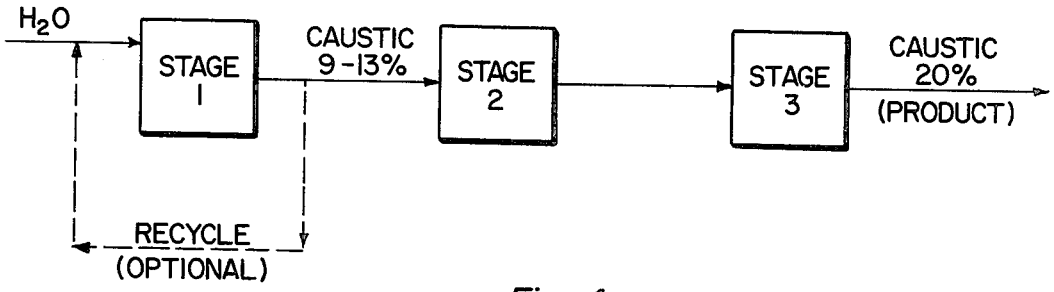
FIG. 4 represents diagramatically an embodiment employing a staged array of chlor-alkali cells.

It is found that the energy consumption is least when the caustic is recycled and diluted around that stage in a series of stages, which stage has a cathode effluent having a concentration in the range of from about 9 to about 13 percent. For example, using an array of the five cells of Example 5, the first three cells comprising the first stage are operted with their respective cathode feeds flowing in parallel. Part of the effluent from the three combined parallel cells (stage 1) is recycled to the influent feed to the cathode compartments where it is diluted with water and is fed to the cathodes of the three combined parallel cells. The remainder of the combined effluent is sent to the cathode compartment of the fourth cell (stage 2) and the liquid effluent from that cathode becomes the influent to the cathode compartment of the fifth cell (stage 3). The water fed is adjusted so that the effluent from the cathode compartment of the fifth cell (stage 3) is about 20 percent caustic. It is found that the electrical energy consumption per unit of 20 percent caustic is substantially less than in Example 5. The concentration of caustic effluent from the combined, parallel cathodes of the first stage is in the range of from about 9 to about 13 percent as shown in FIG. 4.

The foregoing disclosure is intended to be illustrative of representative and preferred forms of the present invention. In the claims appended hereto where elements of the method and apparatus are referred to generically, it is intended that such reference shall embrace the corresponding elements described in the disclosure and equivalents thereof. It is intended that the claims shall cover and embrace the invention both generically and specifically, the disclosure being illustrative and the invention to be accorded the full scope of the claims.

The embodiments of this invention in which an exclusive property or privilege is claimed are defined as follows:

1. In a process wherein an aqueous alkali metal chloride solution is electrolyzed in a chlor-alkali appartus including a cell having an anode compartment containing an anode capable of generating chlorine and lesser amounts of oxygen from aqueous chloride solution, a cathode compartment containing a cathode and a substantially fluid impervious, cation permselective membrane separting said anode compartment from said cathode compartment, the improvement comprising controlling the pH of the anolyte by operating said anode to have an oxygen evolution efficiency substantially chemically equivalent to the hydroxide ion transfer efficiency of the said membrane whereby the formation of excessive chlorates and hypochlorites in said anolyte and insoluble metallic hydroxide in said membrane is substantially reduced.

2. A chlor-alkali apparatus including a cell comprising an anode compartment containing an anode, a cathode compartment containing a cathode, a substantially fluid impervious cation permselective membrane separating said anode and cathode compartments, said membrane having a hydroxide ion transfer efficiency, said anode having an oxygen evolution efficiency substantially equivalent chemically to said hydroxide ion transfer efficiency of said membrane.

3. The apparatus of claim 2 in which the anode is a composite anode having at least one region having a higher oxygen evolution efficiency than the remaining regions of said composite anode.

4. The apparatus of claim 3 including means for separately controlling the current density in said one region relative to said remaining regions of said composite anode.

5. The apparatus of claim 3, wherein said composite anode comprises at least one region containing a coating of manganese dioxide having a high efficiency for oxygen evolution.

6. Apparatus according to claim 2 in which at least one of the electrodes is foraminous and is in contact with the membrane.

7. Apparatus according to claim 6 wherein a catalytically active layer for said electrode is partially imbedded in the membrane.

8. The apparatus according to claim 2 in which the membrane comprises a perfluorocarbon having active groups selected from the group consisting of sulfonate, sulfonamide, carboxylate and phosphonate and has a hydroxide ion transfer efficiency of more than about 5 percent.

9. Apparatus according to claim 2 in which the anode is a composite anode having at least one region having an oxygen evolution efficiency of at least about 95 percent, the remaining regions having a chlorine evolution efficiency of at least about 95 percent, the ratio of the active areas of said one region to the active area of said remaining region being substantially equal to the ratio of the hydroxide ion transfer efficiency of said membrane to the cation transfer efficiency.

10. Apparatus according to claim 2 including:

(a) means for measuring the pH of the liquid effluent from the anode compartments;

(b) pH responsive means for increasing the fraction of said liquid effluent which is recycled to said anode compartment after substantial resaturtion when said pH increases and for decreasing the fraction when said pH decreases.

11. A chlor-alkali apparatus comprising:

(a) at least one electrolytic cell comprising an anode compartment containing an anode, a cathode compartment containing a cathode, a substantially fluid impervious cation permselective membrane separating said anode and cathode compartments, said membrane having a finite hydroxide ion transfer efficiency, said anode having an oxygen evolution efficiency substantially equivalent chemically to said hydroxide ion transfer efficiency of said membrane;

(b) means for controlling the temperature of the fluid immediately effluent from said cathode compartment to the range of from about 70° to about 95° C.;

(c) means for controlling the concentration of the effluent from said cathode compartment to at least about 8 percent by weight of alkali hyroxide; and (d) means for controlling the current density at said membrane to the range of from about 10 to about 35 amperes per square decimeter.

12. Apparatus according to claim 11 including means for controlling the concentration of any non-monovalent cation in the liquid feed to said anode compartment to less than about 2 ppm.

13. A chlor-alkali apparatus including:

(a) at least one electrolytic cell comprising an anode compartment containing a coated electrolytic valve metal anode, a cathode compartment containing a cathode, a substantially fluid impervious perfluorocarbon cation permselective membrane having active groups selected from the group consisting of sulfonate, sulfonamide, carboxylate and phosphonate separating said anode and cathode compartments, said membrane having a hydroxide ion transfer efficiency in excess of about 5 percent, said anode having an oxygen evolution efficiency substantially equivalent chemically to said hydroxide ion transfer efficiency of said membrane;

(b) means for separating the liquid effluent from the cathode compartment from the gaseous effluent therefrom;

(c) means for cooling the liquid effluent by evaporation to a temperature of substantially less than about 70° C.;

(d) means for measuring the temperature of the liquid immediately effluent from said cathode compartment;

(e) temperature responsive means for controlling the temperature of said liquid immediately effluent to the range of from about 70° to about 95° C. by exchanging heat between said cooled liquid effluent and the influent to said cathode compartment.

14. A chlor-alkali apparatus including:

(a) an array of electrolytic cells arranged in stages with each cell comprising an anode compartment containing a coated metallic anode, a cathode compartment containing a metallic cathode, a substantially fluid impervious perfluorocarbon cation permselective membrane separating said anode and cathode compartments, said membrane having a hydroxide ion transfer efficiency of more than about 5 percent, but less than about 30 percent, said anode having a chlorine evolution efficiency of less than about 98 percent but more than about 70 percent;

(b) means for passing at least part of the combined liquid effluent from the cathode compartment(s) from a first stage of such array as influent to the cathode compartment(s) of a second stage of such array;

(c) means for recycling the remainder of said combined liquid effluent and adder water as influent to the cathode compartment(s) of said first stage; and (d) means for controlling the concentration of the combined liquid effluent from the cathode compartment(s) of such first stage to the range of from about 9 to about 13 percent by weight.

15. Apparatus according to claim 14 including:

(a) means for controlling the pH of the liquid effluent from the anode compartments in the range of from about 2 to about 4;

(b) means for controlling the temperature of the liquid immediately effluent from the cathode compartments to the range of from about 70° to about 95° C.;

(c) means from controlling the chloride in the liquid effluents from said anode compartments to a concentration of not less than about 3 gram equivalents per liter.

16. Apparatus according to claim 14 in which the product of the average current density in the first stage by the active membrane area in that stage is substantially greater than the product of the average current density in any subsequent stage by the active membrane area of such subsequent stage.

* * * * *